US006600272B2

(12) United States Patent
Matsui et al.

(10) Patent No.: US 6,600,272 B2
(45) Date of Patent: Jul. 29, 2003

(54) BULB-SHAPED FLUORESCENT LAMP

(75) Inventors: Nobuyuki Matsui, Kyoto (JP); Hiroki Nakagawa, Osaka (JP); Tetsuya Tahara, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 53 days.

(21) Appl. No.: 09/933,246

(22) Filed: Aug. 20, 2001

(65) Prior Publication Data

US 2002/0047612 A1 Apr. 25, 2002

(30) Foreign Application Priority Data

Aug. 29, 2000 (JP) ..... 2000-259420

(51) Int. Cl.[7] ..... H01J 7/44
(52) U.S. Cl. ..... 315/246; 315/46; 315/50
(58) Field of Search ..... 315/209, 219, 315/246, 46, 48, 49, 50, 66; H01J 7/44

(56) References Cited

U.S. PATENT DOCUMENTS 5,714,846 A * 2/1998 Rasch et al. ..... 315/225
6,177,768 B1 * 1/2001 Kamata et al. ..... 315/241 R
6,274,988 B1 * 8/2001 De Vries ..... 315/307
6,469,447 B2 * 10/2002 Nakagawa et al. ..... 315/46

FOREIGN PATENT DOCUMENTS

JP 2000-286088 10/2000
JP 2001-035675 9/2001

* cited by examiner

*Primary Examiner*—Hoanganh Le
(74) *Attorney, Agent, or Firm*—Merchant & Gould P.C.

(57) ABSTRACT

A bulb-shaped fluorescent lamp adopting an inexpensive and highly reliable electronic ballast is provided. A fluorescent arc tube, an electronic ballast, and a base are provided. The electronic ballast lights and drives the fluorescent arc tube, and the base provides a power to the electronic ballast. The electronic ballast has an inductor connected in series to the fluorescent arc tube, and at least two capacitors constituting a resonant circuit with the inductor and connected in parallel to the fluorescent arc tube. At least two capacitors are disposed on the surface of a printed board on the base side. At least two capacitors are disposed stepwise in such a manner that bodies thereof are not opposed to each other and the body with a larger capacitance is spaced further from the fluorescent arc tube.

3 Claims, 5 Drawing Sheets

BULB-SHAPED FLUORESCENT LAMP

BACKGROUND OF THE INVENTION

1. Field of the Invention

The present invention relates to a fluorescent lamp, and particularly to a bulb-shaped fluorescent lamp.

2. Related Background Art

In the last few years, the consciousness for saving energy has increased, and as an alternative low power light source that takes the place of low efficiency bulbs, fluorescent lamps, in particular, bulb-shaped fluorescent lamps, have been developed and used actively.

The bulb-shaped fluorescent lamp basically has an integrated structure, as shown in FIG. 4. The bulb-shaped fluorescent lamp includes a combination of a fluorescent arc tube 18 in which glass tubes each having coiled electrodes 19 and 20 on end portions are bent or jointed to form a series of discharge paths, and an electronic ballast 21 that is a circuit for lighting the fluorescent arc tube 18 stably. The bulb-shaped fluorescent lamp further is provided with a bulb base 22. Typically, the fluorescent arc tube 18 is disposed in an outer tube glass bulb 23, and the electronic ballast 21 is disposed in a resin case 24.

A conventional bulb-shaped fluorescent lamp has addressed important issues such as improvement in characteristics (e.g., lamp efficiency and its life). In addition, it has been attempted to reduce the conventional bulb-shaped fluorescent lamp in its size and weight so as to use it as an alternative to a bulb. As a result, as shown in FIG. 4, the electronic ballast 21 for high frequency lighting is employed currently as a main ballast in the bulb-shaped fluorescent lamp, because it is superior in both aspects such as the improvement in lamp characteristics and reduction in its size and weight.

As shown in FIG. 5, the general purpose lighting circuit of the above-described conventional electronic ballast 21 includes an inverter circuit portion 25, an inductor 26 connected in series to the fluorescent arc tube 18 and a capacitor 27 connected in parallel to the fluorescent arc tube 18. In addition, a positive temperature characteristic resistive element (PTC) 28 connected in parallel to the fluorescent arc tube 18 is installed as in almost all circuits.

Hereinafter, an operation of lighting a lamp by the conventional lighting circuit will be described.

(a) First, when a power supply 29 is turned on, a preheat current sufficient for starting the arc tube flows through the coiled electrodes 19 and 20 via the capacitor 27 and the positive temperature characteristic resistive element 28.

(b) Next, when the resistance of the positive temperature characteristic resistive element 28 becomes high due to a rise in temperature, a so-called resonant voltage (peak value: 700 V to 1000V) of the inductor 26 and the capacitor 27 is applied to the fluorescent arc tube 18, whereby the fluorescent arc tube 18 starts.

(c) Thereafter a predetermined lamp current flows through the fluorescent arc tube 18, and the lamp starts to light steadily. During steady lighting of the lamp, a current also continuously flows through the capacitor 27 via the coiled electrodes 19 and 20.

As described above, the conventional lighting circuit in which the capacitor 27 is connected in parallel to the fluorescent arc tube 18 has a relatively simple configuration. In addition, it is characterized in that the coiled electrodes 19 and 20 are preheated sufficiently and supplied with a predetermined starting voltage when the lamp starts. In this respect, it is considered to be an inexpensive and reliable circuit.

Moreover, as shown in FIG. 4, during assembly of the circuit parts of the electronic ballast 21, main parts including the capacitor 27 are disposed and mounted on the surface of a printed circuit board 30 on the base 22 side. This allows the printed circuit board 30 to thermally insulate the main parts from a heat source or the fluorescent arc tube 18 during lighting of the lamp, thereby suppressing a temperature rise in the main parts.

As a recent trend of a bulb-shaped fluorescent lamp, a high watt-type lamp of 20 W or more (e.g., 22 W to 25 W) has been developed as an alternative to a 100 W bulb, along with a low watt-type lamp of 13 W as an alternative to a 60 W bulb. Since a 60 W bulb is the same as a 100 W bulb in shape, in the development of this high watt-type lamp, it also has been attempted to miniaturize the lamp as an alternative to a bulb. That is to say, a high watt-type lamp is required while it is kept as small as possible.

The present inventors employed the electronic ballast 21 composed of a basic characteristic circuit of the prior art, as shown in FIG. 4 and worked toward the development of a similar small high watt-type lamp. As a result, it was found that a temperature rise particularly in the circuit parts of the electronic ballast cannot be avoided, which results in an occurrence of circuit failure and a short life of the lamp. Further, the analysis of the lamp with a short life revealed that the circuit failure is caused mainly by the damage of the capacitor 27 connected in parallel to the fluorescent arc tube 18 in FIG. 4 due to its temperature rise.

SUMMARY OF THE INVENTION

It is an object of the present invention to solve the above-described problems by providing a bulb-shaped fluorescent lamp adopting an inexpensive and reliable electronic ballast.

To achieve the above object, the bulb-shaped fluorescent lamp of the present invention includes a fluorescent arc tube, an electronic ballast for lighting and driving the fluorescent arc lamp, and a base for providing power to the electronic ballast, which are arranged in this order. The electronic ballast includes an inductor connected in series to the fluorescent arc tube and at least two capacitors constituting a resonant circuit with the inductor and connected in parallel to the fluorescent arc tube.

In this bulb-shaped fluorescent lamp, it is preferable that at least two capacitors are disposed on the surface of a printed board constituting the electronic ballast on the base side, and their bodies are disposed stepwise without being opposed to each other. In this case, it also is preferable that as the capacitance of at least two capacitors becomes larger, their bodies are spaced further from the fluorescent arc tube and disposed stepwise.

According to the above-described constitution, the bulb-shaped fluorescent lamp adopting an inexpensive and reliable electronic ballast can be realized, in which the surface temperature of at least two capacitors during steady lighting of the lamp is kept at not more than a guaranteed upper limit operating temperature, resulting in reduction of damage to the at least two capacitors during the use of the lamp.

DETAILED DESCRIPTION OF THE INVENTION

Figure 1A:
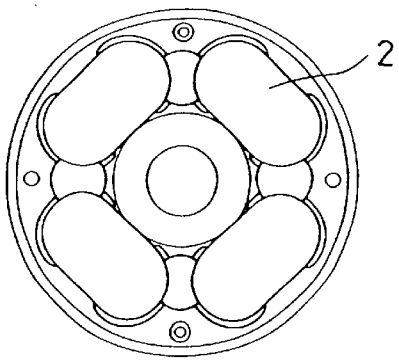
FIG. 1A is a top plan view of a fluorescent arc tube of a bulb-shaped fluorescent lamp of an embodiment according to the present invention with an outer tube bulb and a resin case removed therefrom.
Figure 1B:
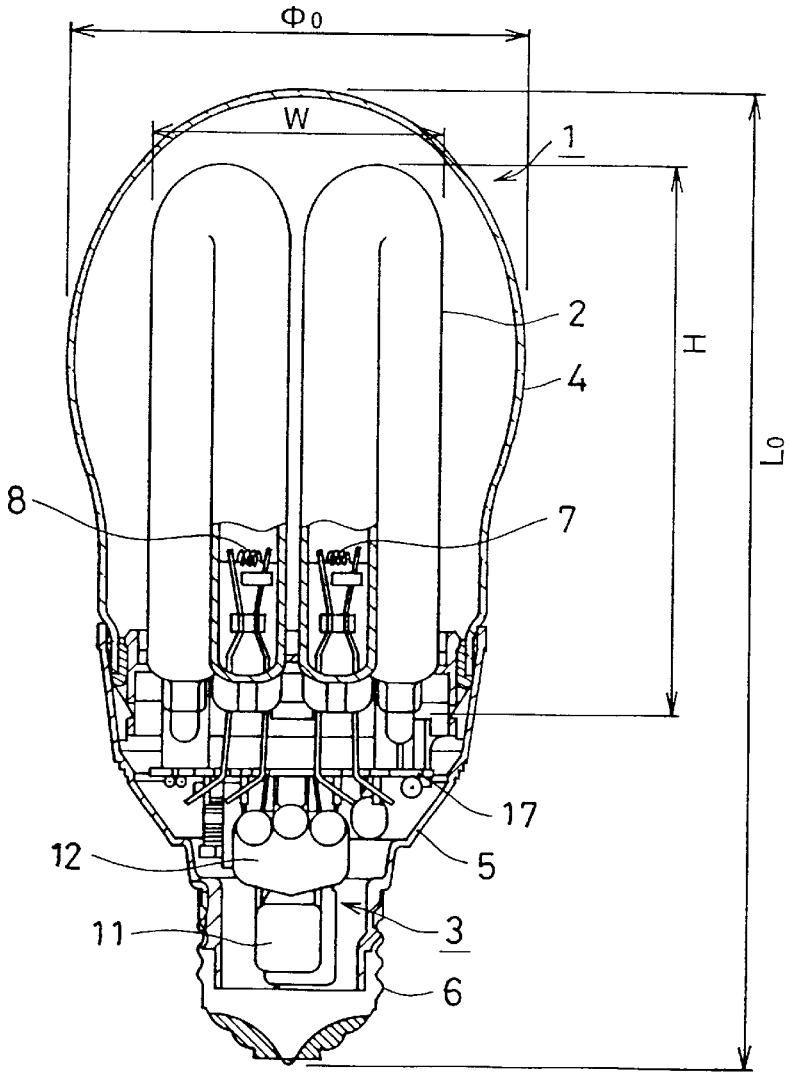
FIG. 1B is a sectional front view showing an entire structure of the bulb-shaped fluorescent lamp of an embodiment according to the present invention.

Hereinafter, the present invention will be described by way of an illustrative embodiment with reference to FIG. 1A to FIG. 3. FIG. 1A is a top plan view of a fluorescent arc tube 2 of a bulb-shaped fluorescent lamp 1 of an embodiment according to the present invention with an outer tube bulb 4 and a resin case 5 removed therefrom. FIG. 1B is a partially taken-away front view showing the entire structure of the bulb-shaped fluorescent lamp of the present embodiment. Moreover, the bulb-shaped fluorescent lamp shown in FIG. 1A and FIG. 1B uses a high watt-type lamp of 20 W or more (e.g., 22 W).

In FIG. 1B, the bulb-shaped fluorescent lamp 1 has a structure in which a combination of the fluorescent arc tube 2 and an electronic ballast 3 is disposed within the outer tube bulb 4 made of glass or resin and the resin case 5, and a base 6 is mounted on an end portion of the resin case 5.

The fluorescent arc tube 2 includes four U-shaped glass tubes interconnected by a so-called bridge joint so as to form a series of discharge paths (see FIG. 1A), and filament coiled electrodes 7 and 8 made of tungsten are provided at the end portions of each U-shaped glass tube. The surface of the tube is coated with a rare earth phosphor emitting light at three wavelengths, and the tube is filled with mercury and argon gas with a pressure of 300 Pa as a buffer rare gas.

Herein, the fluorescent arc tube 2 has a small shape with an outer diameter of 10.8 mm, a distance between the electrode tubes of 490 mm, a height H of 77 mm, and a width W of 41 mm.

The bulb-shaped fluorescent lamp 1 also is characterized by its small shape. More specifically, the upper limit of an outer diameter $\Phi_0$ of the outer tube bulb 4 is 68 mm and the upper limit of a full length $L_0$ of the lamp is 147 mm. (The upper limit of the outer diameter $\Phi_0$ is 60 mm and the upper limit of the full length $L_0$ of the lamp is 110 mm for a 100 W bulb).

Because of the above structure of the lamp, excellent characteristics can be obtained in which a luminous flux of a lamp is 1520 lm (equal to that of a 100 W bulb) and lamp efficiency is 69 lm/W.

Figure 2:
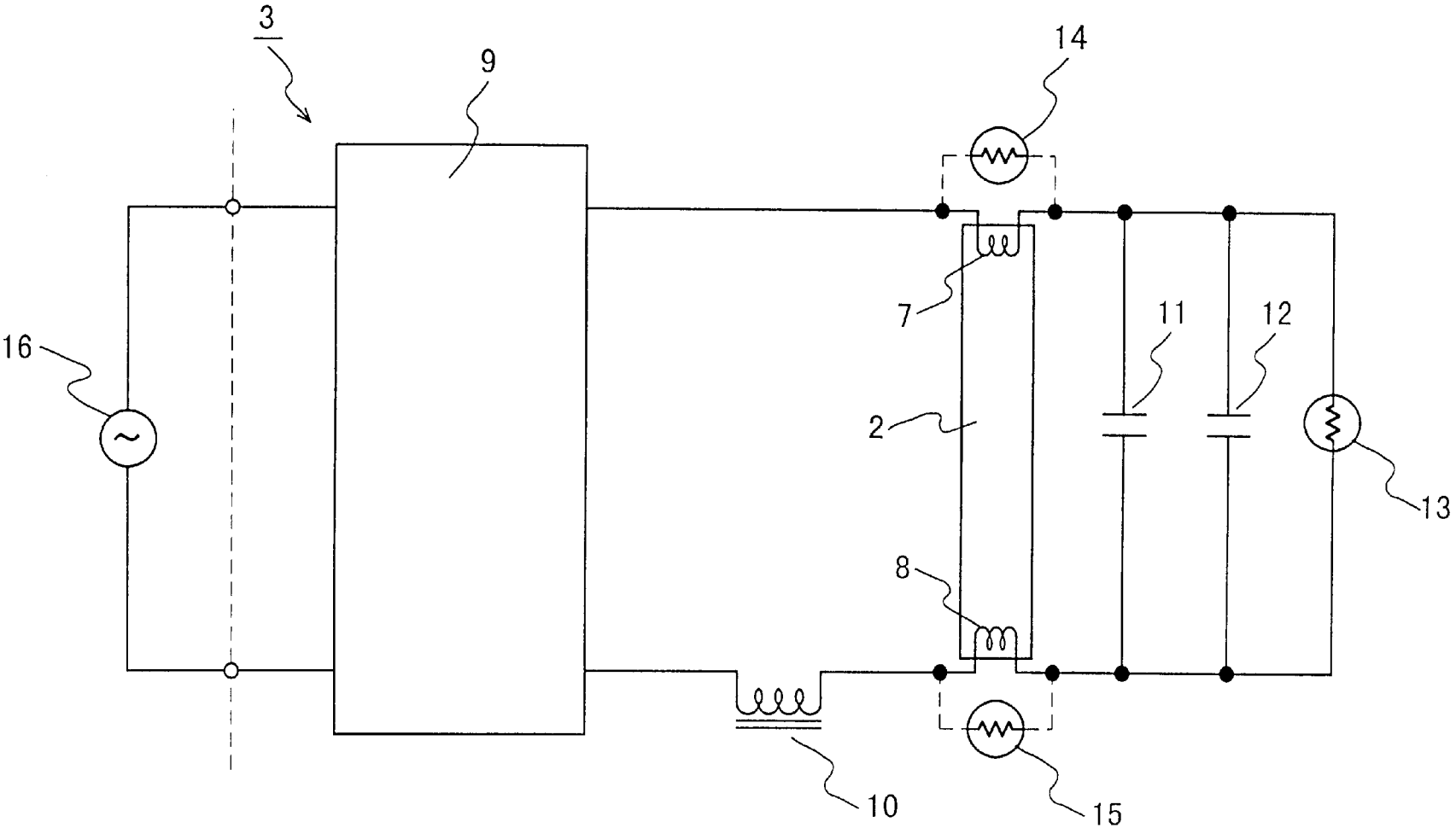
FIG. 2 is a circuit diagram showing a basic structure of a lighting circuit of the electronic ballast shown in FIG. 1.

FIG. 2 is a circuit diagram showing a basic structure of a lighting circuit of the electronic ballast 3 in the bulb-shaped fluorescent lamp 1 of the present embodiment.

In FIG. 2, the lighting circuit basically is composed of an inverter circuit portion 9 of a series inverter system, an inductor 10, capacitors 11 and 12 connected in parallel to the fluorescent arc tube 2, and a positive temperature characteristic resistive element (PTC) 13. Herein, polyester capacitors particularly excellent in pressure and heat resistance are used as the capacitors 11 and 12. In addition, a lamp lighting frequency is set at 75 kHz.

For the purpose of reducing the lamp wattage, as indicated by broken lines, the lighting circuit of FIG. 2 may be provided with negative temperature characteristic resistive elements (NTC) 14 and 15 connected in parallel to the coiled electrodes 7 and 8 respectively. Thus, most current that flows through the capacitors 11 and 12 during steady lighting of the lamp flows not through the coiled electrodes 7 and 8 but through the negative temperature characteristic resistive elements 14 and 15 that become low resistant because of a temperature rise. This reduces a loss of electric power for heating by approximately 0.8 W when a current flows through the coiled electrodes 7 and 8.

Figure 4:
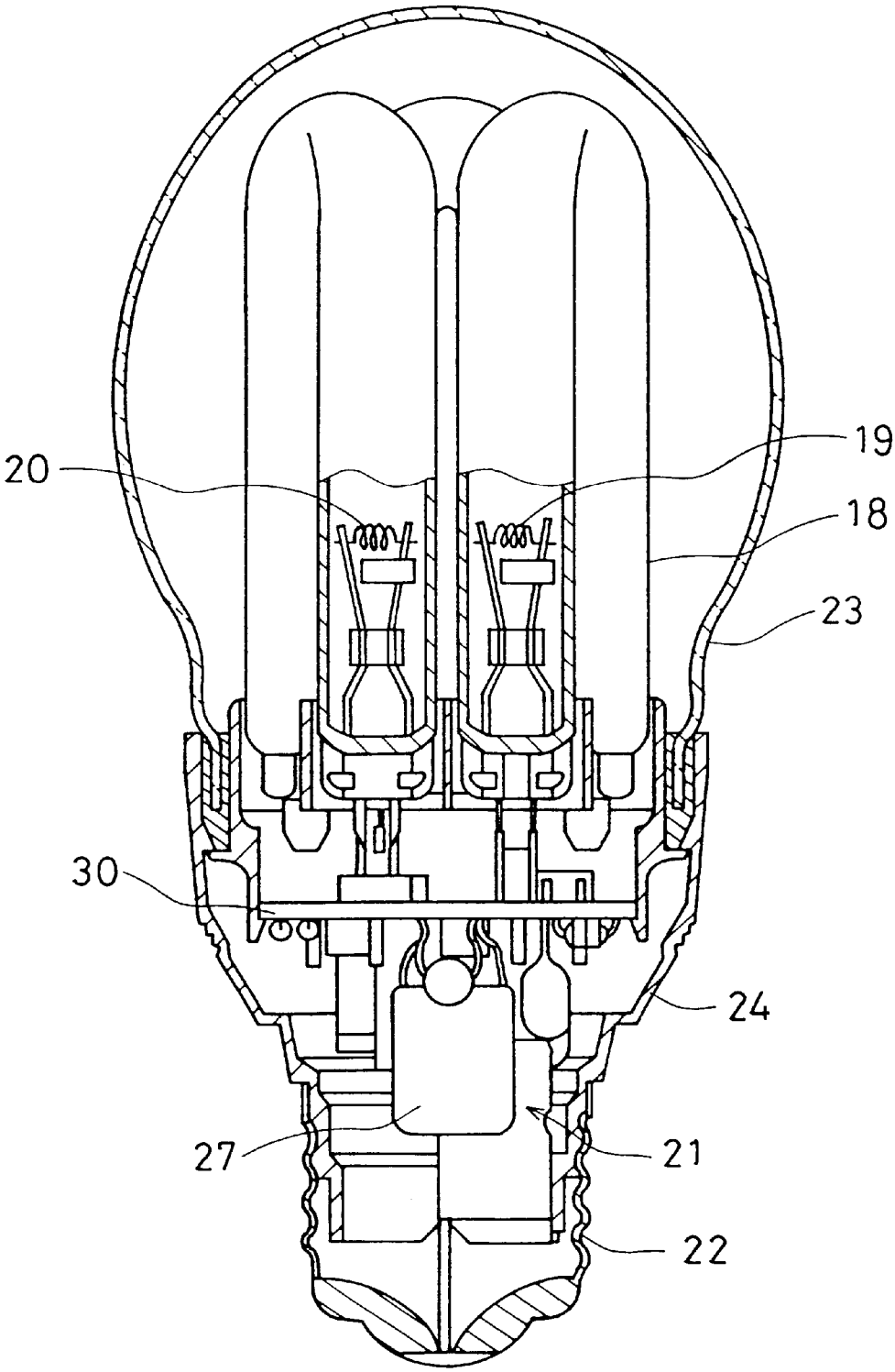
FIG. 4 (PRIOR ART)
FIG. 4 is a sectional front view showing the entire structure of a conventional bulb-shaped fluorescent lamp.
Figure 5:
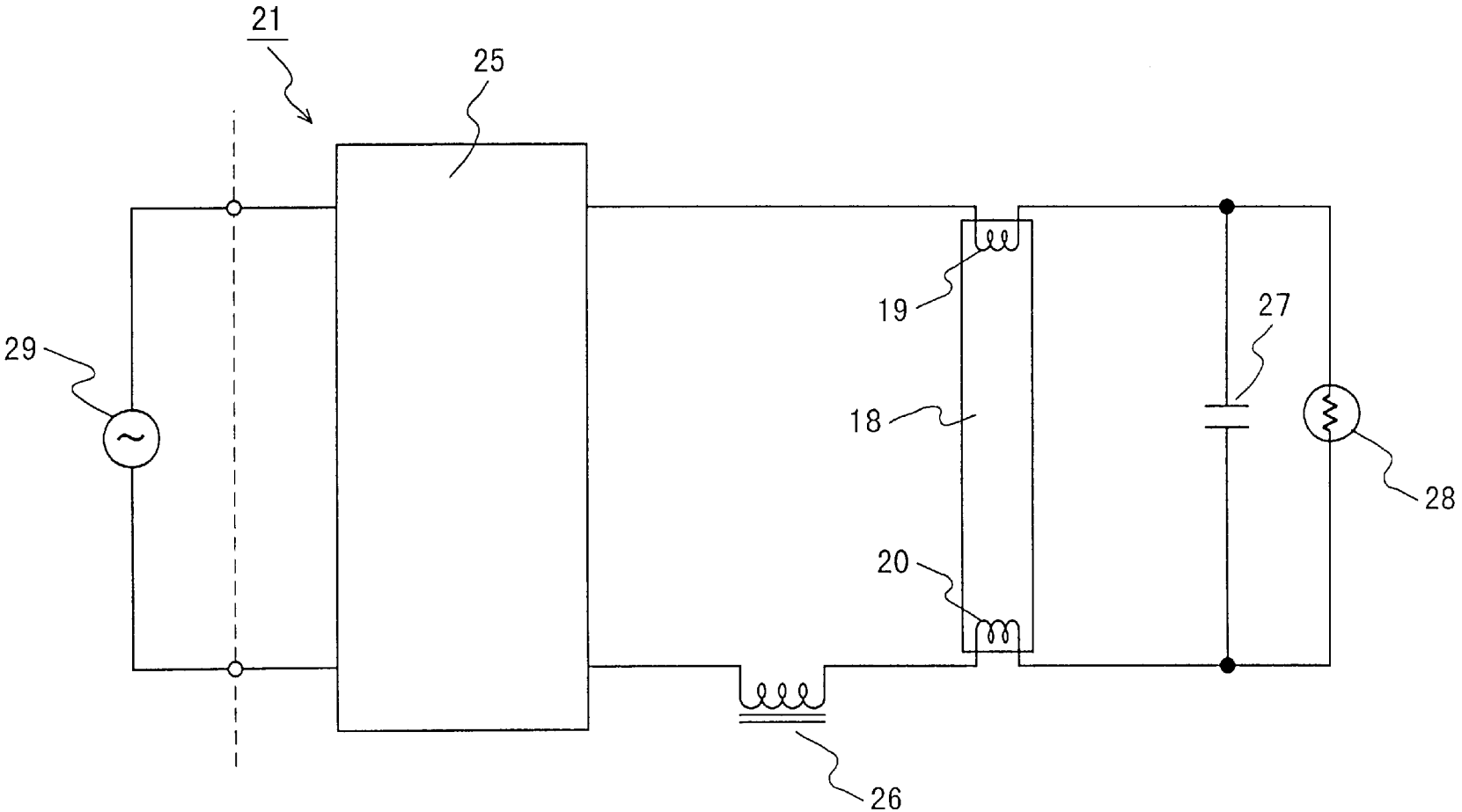
FIG. 5 (PRIOR ART)
FIG. 5 is a circuit diagram showing a basic structure of a lighting circuit of a conventional electronic ballast.

The lighting circuit of the electronic ballast 3 in the present embodiment is characterized in that the capacitors 11 and 12 are connected in parallel to the fluorescent arc tube 2, while the capacitor 27 is connected in parallel to the fluorescent arc tube in the conventional circuit of FIG. 4. Further, the lighting operation of the lighting circuit in the present embodiment basically is the same as that of the conventional circuit of FIG. 4. However, a current flows separately through the capacitors 11 and 12 in the lighting circuit in the present embodiment, while the current flows through the capacitor 27 in the conventional lighting circuit.

Hereinafter, the specific configuration of the lighting circuit of the electronic ballast 3 in the present embodiment will be described.

First, the values of the capacitors 11 and 12 were set at 3900 pF and 2700 pF, respectively in connection with the way of assembling parts described below. In this case, considering the actual use in practice, diverted currents flowing through the capacitors 11 and 12 during steady lighting in an aging test under the conditions of lighting in a light socket for a bulb and lighting at 110 V (the rated value is 10% up) of a commercial power supply 16 were 200 mA and 130 mA, respectively.

Next, an aging test was conducted with a bulb-shaped fluorescent lamp 1 of high watt type (22 W) incorporating the electronic ballast 3 with the above circuit configuration under the same lighting conditions as described above.

As a result, it was confirmed that damage to the capacitors 11 and 12 did not occur and an intended lamp life time of 6000 hrs was guaranteed.

It also was confirmed that surface temperatures of the capacitors 11 and 12 during steady lighting in the aging test were 116° C. and 121° C. respectively, both of which were not more than a guaranteed upper limit operating temperature of 130° C.

Further, it was found that when diverted currents of 200 mA and 130 mA flowed through the capacitors 11 and 12 as single parts respectively, the self temperature increases $\Delta$ Ts were 13.9 deg and 12.3 deg respectively, both of which were not more than a guaranteed upper limit of 15 deg.

Then, for comparison, the bulb-shaped fluorescent lamp incorporating an electronic ballast composed of the capacitor 27 was considered in a similar way to the conventional circuit of FIG. 4. In this case, a capacitance of the capacitor 27 was set at 6600 pF so that the coiled electrodes 7 and 8 of the fluorescent arc tube 2 were supplied during startup with a sufficient preheat current and a predetermined starting voltage (Weak value: approximately 1000 V).

An aging test was conducted in the above test lamp under the above lighting conditions, and the lamp life characteristics at that time were studied. As a result, it was found that lamp non-lighting phenomenon occurred at an aging time of approximately 1200 hrs, while the intended rated lamp had a life time of 6000 hours. In addition, the analysis of the defective lamp with a short life revealed that the capacitor 27 was damaged so as to be in a conducting state.

When measuring a surface temperature Ts of the capacitor 27 during steady lighting in the aging test of the above test lamp, it was found that a Ts value exceeded the guaranteed upper limit operating temperature of 130° C. and reached 136° C. at maximum. In addition, when the capacitor 27 was taken away as a single part, and a so-called self temperature rise Δ Ts (Herein, Δ Ts refers to a value obtained by subtracting an ambient temperature Ta at measurement of the part from the surface temperature of the capacitor 27 supplied with the same current) was measured at a current value of 330 mA, which was the same as that of a current flowing through the capacitor 27 during steady lighting of the lamp, it was found that the Δ Ts value exceeded the guaranteed upper limit of 15 deg and reached 24.7 deg.

Thus, it was confirmed that as optimal means for preventing the damage phenomenon of the capacitor 27, the lighting circuit basically composed of the capacitors 11 and 12 might be used, as shown in FIG. 2. Although it apparently can be simple, it also is highly reliable and easily applicable for its simplicity.

Figure 3:
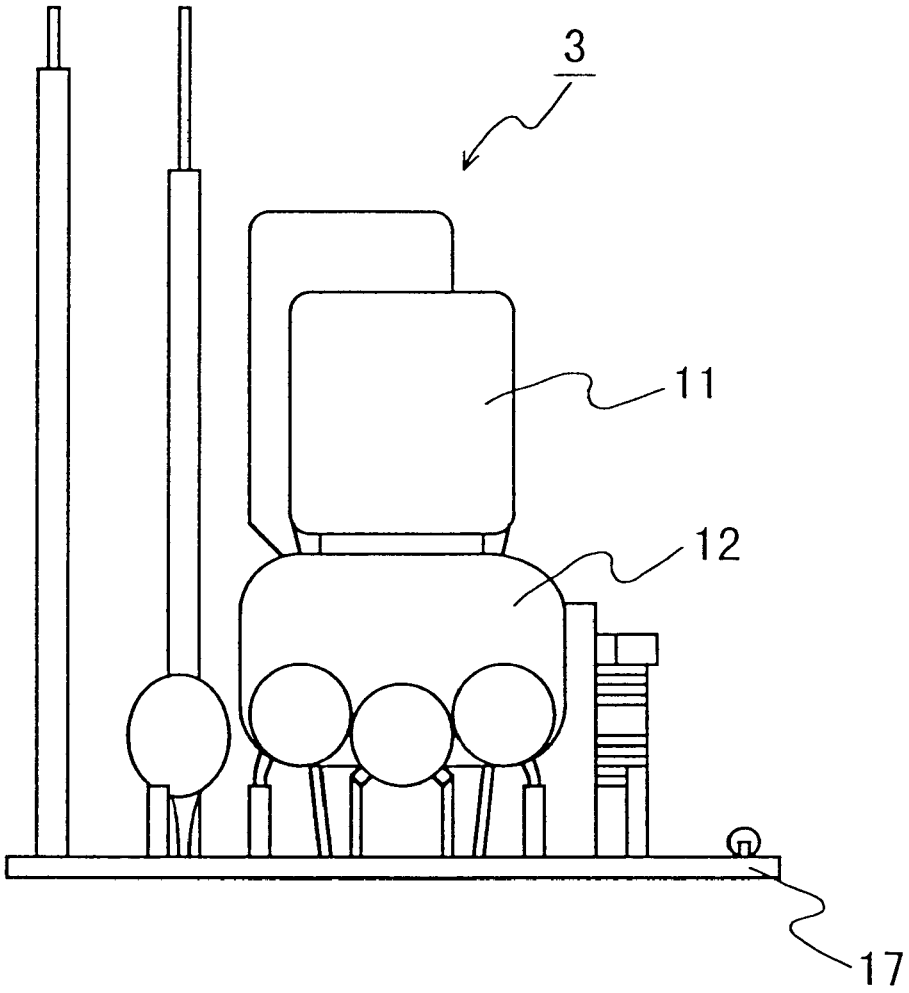
FIG. 3 is an assembly arrangement view of circuit parts of the electronic ballast shown in FIG. 1.

Further, as shown in FIG. 3, in assembling parts of the electronic ballast 3, when the capacitors 11 and 12 were disposed and mounted on the surface of the printed circuit board 17 on the base 6 side, both bodies (excluding the lead portion) were never opposed to each other even partially but disposed stepwise. Herein, when both the bodies were opposed to each other and disposed tightly, each surface temperature during steady lighting of the lamp sometimes exceeded the guaranteed upper limit temperature. In contrast, the above-described stepwise arrangement assured that the surface temperatures of the capacitors 11 and 12 were kept at the guaranteed upper limit operating temperature of 130° C. or less.

Moreover, in the above-described stepwise arrangement, the capacitor 11 allowing more diverted current to flow therethrough at a capacitance of 3900 pF was disposed in the second step far from the fluorescent arc tube 2 to be a heat source, while the capacitor 12 allowing less diverted current to flow therethrough at a capacitance of 2700 pF was disposed in the first step near the fluorescent arc tube 2. This equalized the surface temperatures of both the capacitors during steady lighting of the lamp more exactly, thereby keeping them at the guaranteed upper limit operating temperature of 130° C. or less.

In the above-described assembling of parts, the stepwise arrangement of the capacitors 11 and 12 is another characteristic of the lighting circuit configuration in the present embodiment.

In the present embodiment, the capacitors 11 and 12 are used instead of the capacitor 27 of the prior art. However, basically, even in the case where a plurality of capacitors, for example, three capacitors are used, the same effects can be obtained.

In the present embodiment, although the structure of the bulb-shaped fluorescent lamp having the outer tube bulb 4 is described, the similar effect can be obtained in a fluorescent lamp without the outer tube bulb 4.

As described above, according to the present invention, a bulb-shaped fluorescent lamp adopting an inexpensive and reliable electronic ballast can be realized in which the damage to capacitors connected in parallel to a fluorescent arc tube can be reduced during use of the lamp.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A bulb-shaped fluorescent lamp comprising:

a fluorescent arc tube;

an electronic ballast for lighting and driving the fluorescent arc tube; and a base for providing a power to the electronic ballast, wherein the electronic ballast is disposed between the fluorescent arc tube and the base, and has an inductor connected in series to the fluorescent arc tube and at least two capacitors constituting a resonant circuit with the inductor and connected in parallel in an unswitched manner to a non-power supply side of the fluorescent arc tube.

2. The bulb-shaped fluorescent lamp according to claim 1, wherein the at least two capacitors are disposed on a surface of a printed board constituting the electronic ballast on the base side, and bodies of the at least two capacitors are disposed stepwise without being opposed to each other.

3. The bulb-shaped fluorescent lamp according to claim 2, wherein the bodies of the at least two capacitors are disposed stepwise in such a manner that the body of the capacitor with a larger capacitance is spaced further from the fluorescent arc tube.

* * * * *